US006474064B1

(12) United States Patent
Heyne et al.

(10) Patent No.: US 6,474,064 B1
(45) Date of Patent: Nov. 5, 2002

(54) HYDRAULIC SYSTEM AND METHOD FOR REGULATING PRESSURE EQUALIZATION TO SUPPRESS OSCILLATION IN HEAVY EQUIPMENT

(75) Inventors: Dennis J. Heyne; Richard J. Lech; Eric Sharkness, all of Burlington, IA (US)

(73) Assignee: Case Corporation, Racine, WI (US)

( * ) Notice: Subject to any disclaimer, the term of this patent is extended or adjusted under 35 U.S.C. 154(b) by 0 days.

(21) Appl. No.: 09/661,348

(22) Filed: Sep. 14, 2000

(51) Int. Cl.[7] ..... F16D 31/02
(52) U.S. Cl. ..... 60/468; 60/469; 91/38
(58) Field of Search ..... 60/468, 469, 494, 60/459, 329; 91/38

(56) References Cited

U.S. PATENT DOCUMENTS

| | | | | |
|---|---|---|---|---|
| 3,407,946 A | | 10/1968 | Pilch | |
| 3,530,766 A | | 9/1970 | Pilch | |
| 3,815,766 A | | 6/1974 | Carlson et al. | |
| 3,872,985 A | | 3/1975 | Short | |
| 4,065,010 A | | 12/1977 | Worback | |
| 4,586,332 A | * | 5/1986 | Schexnayder | 60/468 |
| 4,628,690 A | * | 12/1986 | Arai et al. | 60/468 |
| 4,694,649 A | * | 9/1987 | Howeth | 60/494 |
| 5,018,934 A | | 5/1991 | Steinkamp et al. | |
| 5,025,626 A | * | 6/1991 | Crosser et al. | 60/468 |
| 5,048,296 A | * | 9/1991 | Sunamura et al. | 60/468 |
| 5,419,132 A | * | 5/1995 | Sato et al. | 60/468 |
| 5,424,623 A | | 6/1995 | Allen et al. | |
| 5,644,915 A | * | 7/1997 | Dressing et al. | 60/494 |
| 5,709,083 A | * | 1/1998 | Sorbel et al. | 60/468 |

* cited by examiner

*Primary Examiner*—Edward K. Look
*Assistant Examiner*—Igor Kershteyn
(74) *Attorney, Agent, or Firm*—A. N. Trausch

(57) ABSTRACT

The invention provides a system for regulating pressure equalization in hydraulic mechanisms to suppress oscillation in heavy equipment. The system includes a first and second hydraulic lines, a crossover valve in communication with each of the first and second hydraulic lines, a timing system in communication with the crossover valve, and a motion detector in communication with a heavy equipment component. The motion detector senses a linkage motion and operatively opens the crossover valve, which remains open as directed by the timing system.

23 Claims, 4 Drawing Sheets

HYDRAULIC SYSTEM AND METHOD FOR REGULATING PRESSURE EQUALIZATION TO SUPPRESS OSCILLATION IN HEAVY EQUIPMENT

FIELD OF THE INVENTION

In general, the invention relates to hydraulic systems used in the operation of heavy equipment. More specifically, the invention relates to a electrohydraulic or hydraulic system used for regulating pressure equalization to alleviate harsh oscillation common in the operation of heavy equipment, including but not limited to backhoes, excavators, skid steer drives, crawler drives, outriggers, and wheel loaders.

BACKGROUND OF THE INVENTION

In general, construction and other heavy equipment use hydraulic systems to perform digging, loading, craning, and like operations. The speed and direction of these functions are controlled with hydraulic valves. Typically at the end of a moving function, the implement exhibits uncontrolled changes in speed and direction producing an oscillatory motion. For example, in a backhoe, the oscillatory motion occurs when its linkage is brought to a stop following a side-to-side maneuver. This oscillation makes it more difficult for the backhoe operator to return the bucket to a given position. The oscillation is caused when the kinetic energy generated by the backhoe movement is transferred to the hydraulic supply lines connected to the backhoes actuators when stopping. The transferred energy produces a sharp increase (or spike) in fluid pressure. The increased fluid pressure transfers the energy into the hydraulic system and the surrounding vehicle. The energy then returns in the opposite direction through the hydraulic lines and exerts the force into the nonmoving actuators. This transfer of energy continues until it is dispelled as heat, or is dissipated through the oscillation of the equipment and the swelling of the hydraulic lines.

Thus, there is a need for a hydraulic system for reducing the amount of oscillatory motion that occurs when a swinging backhoe or other heavy machinery component is brought to a stop. Further, there is a need for increasing the accuracy of swinging the backhoe or other heavy machinery linkage to a desired location.

SUMMARY OF THE INVENTION

One aspect of the present invention provides a hydraulic system for regulating pressure equalization to suppress oscillation in linkage of heavy equipment. The hydraulic system is comprised of a first and second hydraulic line, a crossover valve in communication with the first and second hydraulic lines, a timing system in communication with the crossover valve, and a motion detector in communication with one of the first or second lines. The motion detector senses linkage or control assembly motion and operatively opens the crossover valve, which remains open as directed by the timing system.

Another aspect of the invention includes a method of operating a hydraulic system to regulate pressure equalization. The method of operation includes restricting directional flow of fluid to a crossover valve. The crossover valve is opened when a predetermined pressure differential is reached in a return hydraulic line. The fluid flow between the return hydraulic line and a supply hydraulic line through the open crossover valve is metered for fluid volume. Equalization of a pilot pressure to the crossover valve is then delayed to extend open time of the crossover valve.

In addition, another aspect the invention provides a means for a hydraulic system to regulate pressure equalization. The means includes a check valve for increasing the fluid pressure in a return hydraulic line. Flow control valves allow fluid pressure to be applied to a crossover valve. The crossover valve meters the fluid pressure between the first and second hydraulic lines. Finally, a restrictive means for delaying equalization of the pressure to the crossover valve to extend open time of the crossover valve is provided.

One embodiment of the invention is comprised of a first and second hydraulic lines, a motion detector, and a crossover valve in communication with each of the supply and return hydraulic lines. These components may operate electrically, mechanically, hydraulically, or a combination thereof. The crossover valve does not open during acceleration, and is set to open and allow flow between the supply and return hydraulic lines when a predetermined signal occurs from the motion detector. Fluid flow is then metered between the supply and return hydraulic lines through the crossover valve. A timing system is in communication with the crossover valve to regulate when the crossover valve closes and stops flow between the supply and return hydraulic lines.

The foregoing and other features and advantages of the invention will become further apparent from the following detailed description of the presently preferred embodiment, read in conjunction with the accompanying drawings. The detailed description and drawings are merely illustrative of the invention rather than limiting, the scope of the invention being defined by the appended claims and equivalents thereof.

DETAILED DESCRIPTION OF THE PRESENTLY PREFERRED EMBODIMENTS

Figure 1:
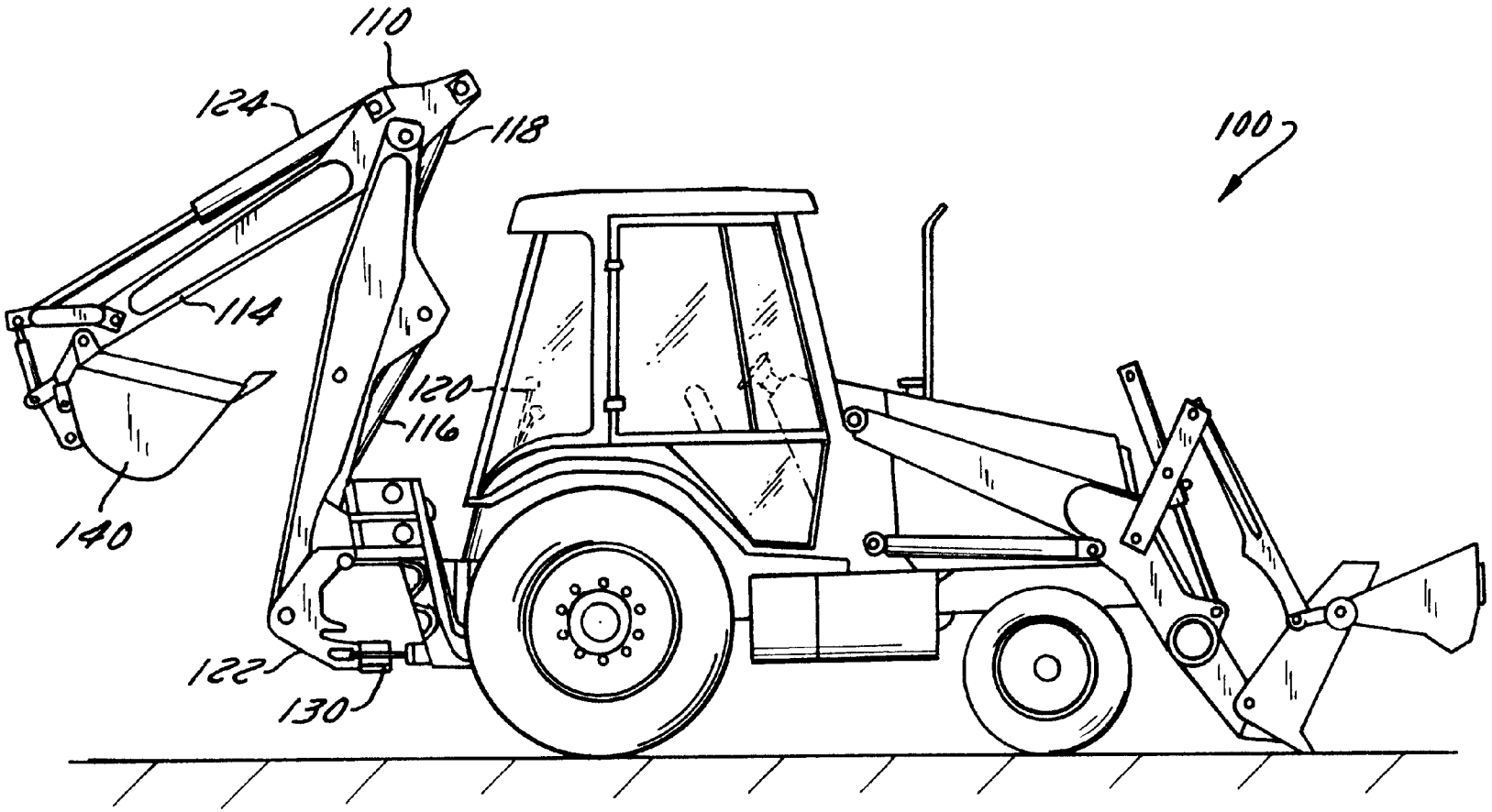
FIG 1 is an illustration of a vehicle showing a backhoe linkage.

Referring to FIG. 1, one embodiment of a vehicle 100 equipped with a backhoe assembly 110 is shown. A heavy equipment operator typically controls the operation of a bucket 140, which is in communication with the backhoe assembly 110, by using a control assembly 120. The control assembly 120 is in communication with a backhoe linkage 130, which is in communication with the backhoe assembly 110. The operation of the control assembly 120 provides fluid flow direction allowing for the activation of at least one swing assembly actuator also known in the trade as a swing cylinder, which is part of the backhoe linkage 130. The backhoe linkage 130 produces a side-to-side movement of the backhoe assembly 110. It is in the backhoe linkage 130 that a transfer of energy occurs and causes an unwanted oscillation.

An example of the energy transfer is detailed with reference to the embodiment of FIG. 1. When the backhoe linkage 130 is brought to a stop following a side-to-side maneuver, kinetic energy that is generated by the movement of the backhoe assembly 110, is transferred to hydraulic supply lines connected to the backhoe actuators of the backhoe linkage 130. The transferred energy produces a sharp increase (or spike) in fluid pressure. The increased fluid pressure transfers the energy as vector forces throughout the hydraulic system and the surrounding vehicle. The energy then returns in the opposite direction through the hydraulic lines and exerts vector forces back to the non-moving actuators. This transfer of energy continues back and forth until it is dispelled as heat, or is dissipated through the oscillation of the equipment and the swelling and contraction of the hydraulic lines.

Figure 2A:
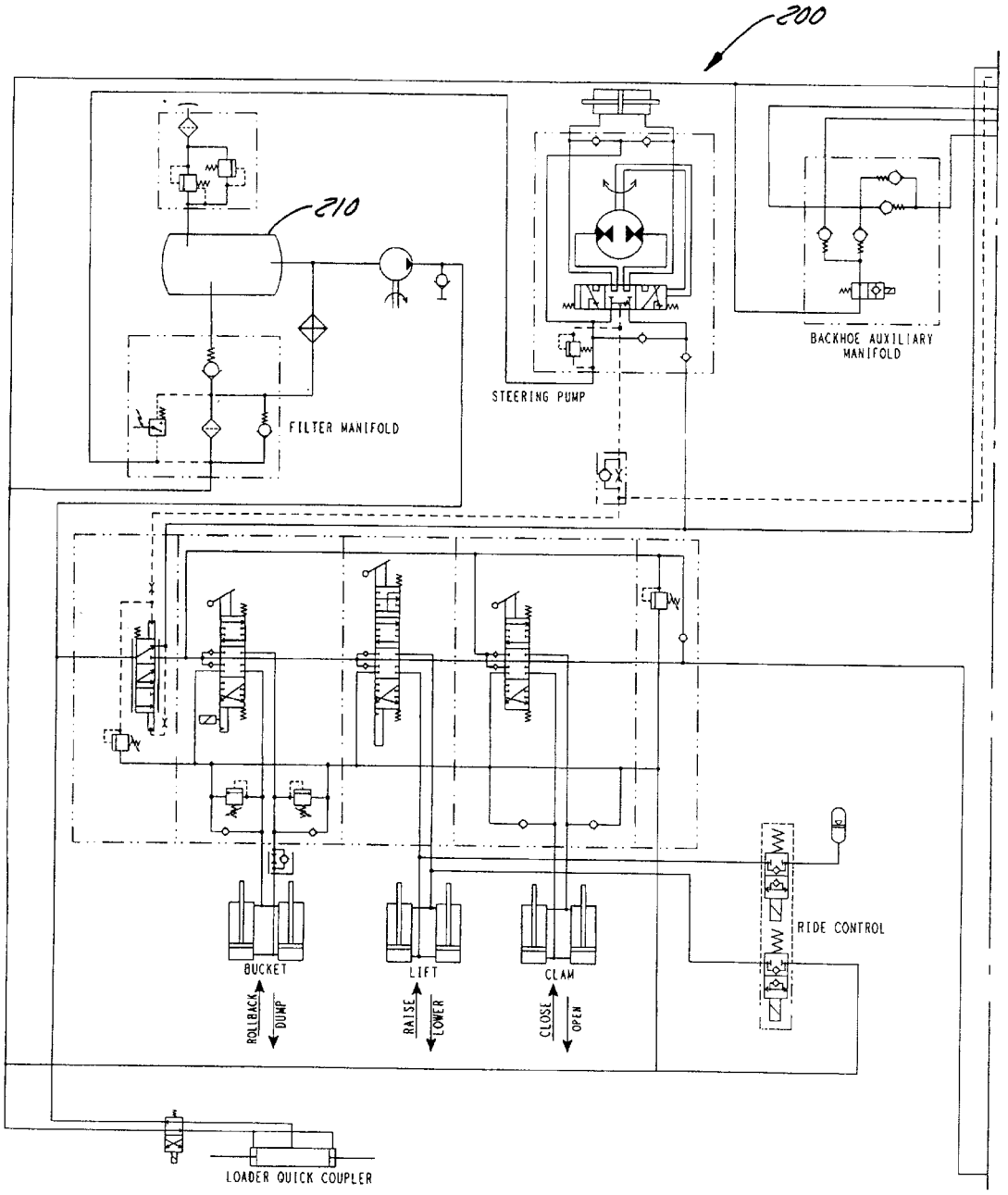
FIGS. 2A and 2B are a schematic diagram of one embodiment detailing the hydraulic components of the backhoe linkage of FIG. 1.
Figure 2B:
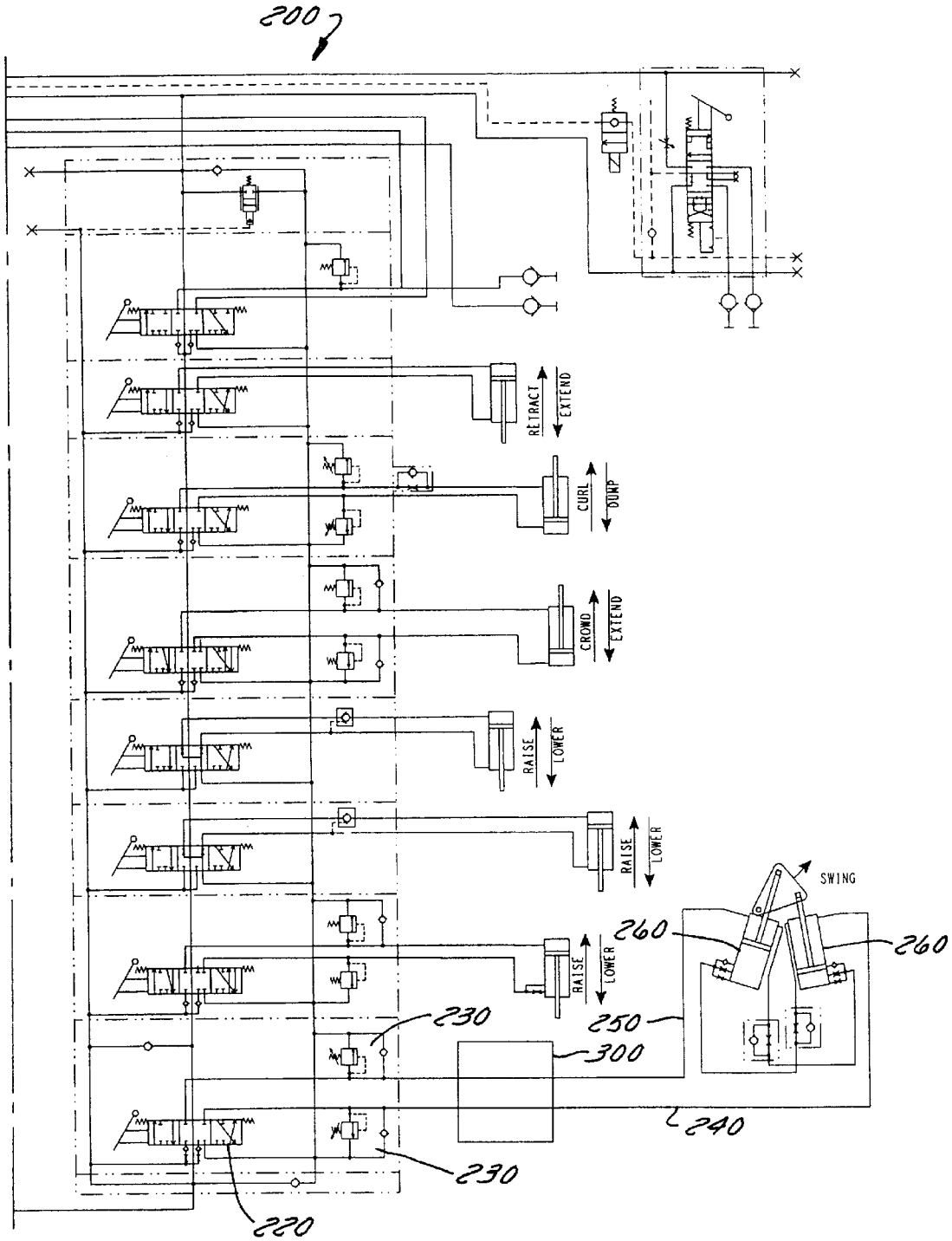

In FIG. 2, the hydraulic components of one embodiment of the invention are illustrated as a schematic 200 detailing a typical piece of heavy equipment utilizing the backhoe assembly 110 of FIG. 1. In this embodiment, a holding tank 210 supplies hydraulic fluid to a control valve 220 via a pump or the like. The hydraulic fluid flows to and from the swing cylinders 260 through the hydraulic lines 240 and 250, with the flow direction controlled by the operations of the control valve 220. The swing cylinders 260 are a component of the backhoe linkage 130, and the control valve 220 is a component of the control assembly 120 of FIG. 1. When the hydraulic line 240, or the hydraulic line 250 experiences an excessive buildup of pressure, a pressure sensitive relief valve 230 opens to allow the pressurized fluid to flow back to the holding tank 210. In this embodiment, the swing cushion device 300 is located in series with the hydraulic lines 240 and 250 between the control valve 220 and the swing cylinders 260 but may be positioned at different locations in alternative embodiments.

Figure 3:
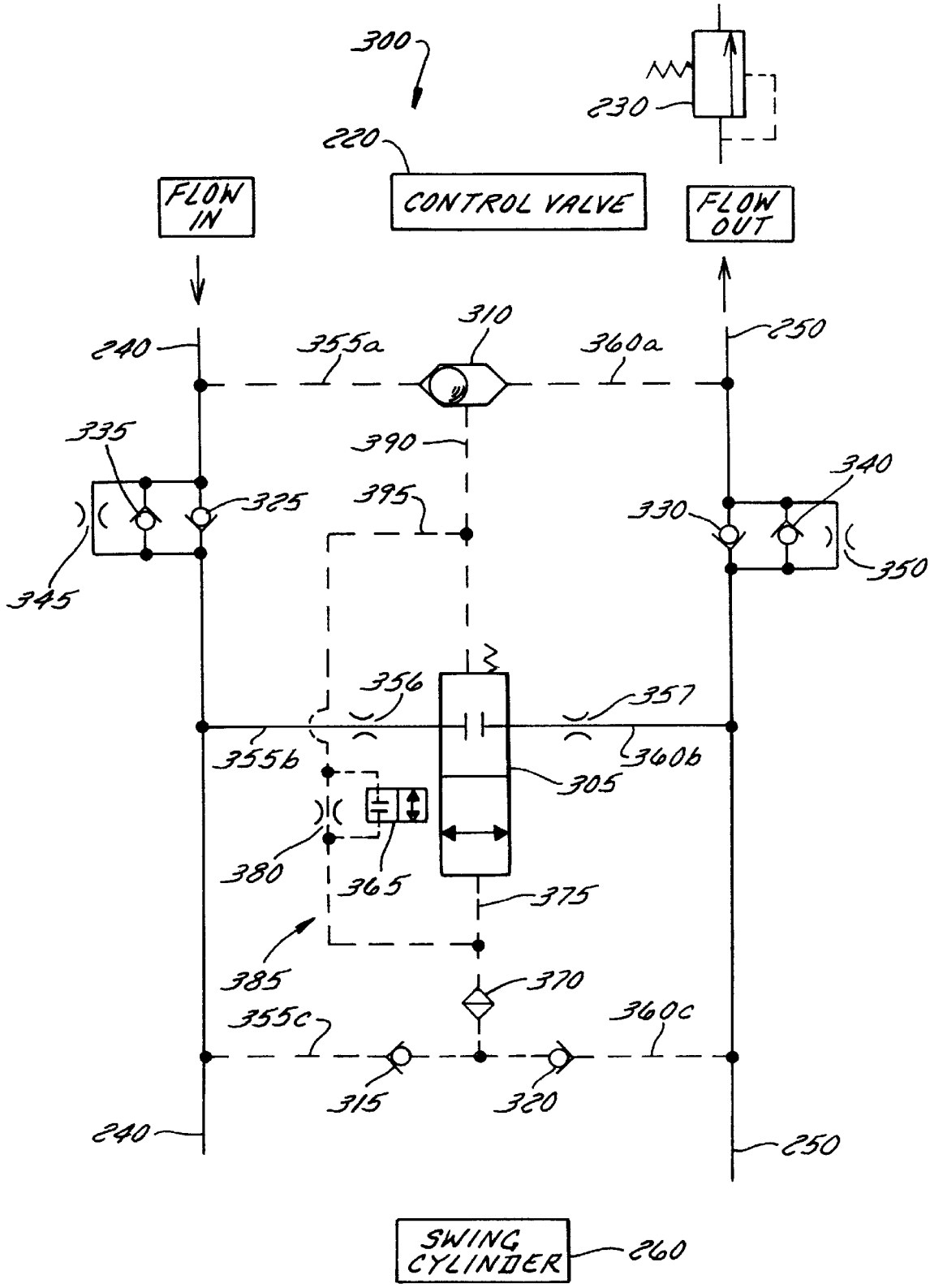
FIG. 3 is a schematic diagram of one embodiment of a hydraulic system made in accordance with the invention.

One embodiment of the present invention is generally shown as a swing cushion system 300 in FIG. 3. This embodiment is hydraulic in its operation but may be electrical or mechanical or a combination of thereof in alternative embodiments. The invention may be used as in this example, as part of the hydraulic components of a backhoe linkage, as demonstrated in FIG. 2. This embodiment entails the use of hydraulic lines 240 and 250 to supply and reclaim hydraulic fluid to the swing cylinders 260 while the control valve 220 directs the fluid flow. The hydraulic lines 240 and 250 may be of any variety used for the transfer of hydraulic fluid, with the hydraulic fluid being of any conventional type. They preferably provide a fluid flow rate of twenty (20) gallons per minute therethrough. The swing cylinders 260 are common in the trade and may vary in size, purpose, and number. A motion detector is used to control the flow of fluid to a crossover valve 305. The motion detector may comprise a variable potentiometer, or other electrical device that detects a measurable property such as resistance or voltage, or a pressure generator such as a check valve or orifice, and is in communication with either the control assembly 120 or the backhoe linkage 130. A motion detection system consisting of components 325, 330, 310, 315, 320 is shown as an illustrative example of one embodiment. An alternative embodiment of the motion detection system may sense fluid pressure, mechanical movement, or controller activation. The hydraulic line 240 is in series communication with check valves 335 and 325, and a bypass orifice 345. The hydraulic line 250 is in series communication with check valves 330 and 340, and a bypass orifice 350. The check valves 335, 325, 330, and 340 may allow flow in varying direction and activation pressures, and an alternative number or type of flow control systems known in the art may be used. Check valves 335 and 340 are 5 psi check valves. The bypass orifices 345 and 350 may be conventional bypass orifices, preferably having a restrictive diameter of 0.030 inches. Altematively, other flow restricting mechanisms may be used or combined with the flow control check valves 335, 325, 330, and 340. Prior to and after the parallel check valves and bypass orifice, hydraulic lines 240 and 250 are in communication through hydraulic lines 355*a*, 355*c*, 360*a*, and 360*c* with flow control valves 310, 315, and 320. Hydraulic lines 355*a*, 355*c*, 360*a*, and 360*c* preferably provide fluid flow therethrough at a rate of less than one (1) gallon per minute. Check valves 315 and 320 are preferably five (5) psi check valves. In FIG. 3 the flow control valves are depicted as a shuttle valve and a pair of check valves respectively, but may be comprised of alternative directional flow control variations. Flow control valve 310 is in communication with a spring side operational port of the crossover valve 305 through a hydraulic line 390. Hydraulic line 390 preferably provides a fluid flow rate of less than one (1) gallon per minute. The crossover valve 305 may be a spool, poppet, solenoid, or other variable position electro-hydraulic or hydraulic valve, and may alternatively be directed to open by motion, pressure, or electric means. A timing system for determining how long the crossover valve 305 allows flow between the hydraulic line 240 and the hydraulic line 250 can be used. The timing system may be electronic, electro-hydraulic, or hydraulic as known in the art. A hydraulic timing system comprised of components 385, 325, 330, and 230 is shown as an illustrative example 300. The crossover valve 305 may use a spring tension system for operation but a valve using an alternative operating system know in the art may be used. The flow control valves 315 and 320 are in communication with a delay volume 375, which is a volume created by the opening of the crossover valve 305. During the closing of the crossover valve 305, the fluid in the delay volume flows through a restrictive system 385 via hydraulic line 395. The restrictive system 385 is comprised of the delay volume 375, a thermal actuated valve 365, and a delay orifice 380. Thermal actuated valve 365 is in the completely closed (left in FIG. 3) position at temperatures greater than 60 degrees Celsius and is in the completely open (right in FIG. 3) position at temperatures below 50 degrees Celsius. Delay orifice 380 preferably has a restrictive diameter of 0.018 inches. Between the delay volume 375 and its connection with hydraulic lines 355*c*, 360*c*, and 395 is a fluid filter 370. The crossover valve 305 is further in communication with hydraulic lines 240 and 250 through hydraulic lines 355*b* and 360*b* respectively, and becomes a metered flow system between hydraulic lines 240 and 250 when the crossover valve 305 is activated. Hydraulic lines 355*b* and 360*b* preferably provide a flow rate of five (5) gallons per minute therethrough. The metered system of hydraulic lines 355*b* and 360*b* are portrayed in FIG. 3 as crossover orifices 356 and 357 but alternative metering systems known in the trade may be used. Orifices 356 and 357 are preferably 0.073 inches in diameter. Further, in communication with hydraulic lines 240 and 250 is at least one relief valve 230. The relief valve 230 uses a spring tension system for operation but a valve using an alternative operating system may be used.

An example of one embodiment of the invention as illustrated in FIG. 3 is detailed next. While the backhoe linkage 130 is not actuated (as when the control assembly 120 is in neutral), the bypass orifice 345 with a restrictive diameter of 0.030", acts as a bypass of the 100-psi check valve 325. The bypass allows fluid from the swing cylinders 260 side of the swing cushion device 300 to replace any fluid seeping from the hydraulic line 240, through the control valve 220. This is done to keep the pressure difference between the flow control valve 310, and flow control valves 315 and 320, below the 40-psi differential needed to shift the spring tension of crossover valve 305.

When the control assembly 120 is operated to actuate the backhoe linkage 130, the pressure in the supply line 240 is higher than the pressure in the reclaim line 250 because of the load induced to accelerate the backhoe assembly 110 on the swing cylinders 260. The higher pressure on the supply side acts to open the flow control valves 310 and 315 on the supply line 240 side. The open flow control valve 310 allows for the supply line 240 to act upon the hydraulic line 390. Hydraulic line 390 in turn acts upon the restrictor assembly 385 and crossover valve 305. The open flow control valve 315 allows for the supply line 240 to act upon the delay volume 375, which in turn acts upon the restrictor assembly 385 and crossover valve 305. Because the 5-psi check valve 335 restricts the fluid flowing in the supply line 240, the pressure on the restrictor assembly 385 and crossover valve 305 from the flow control valve 310 is higher than the pressure on the restrictor assembly 385 and crossover valve 305 from the delay volume 375. The resulting pressure differential is higher on the spring side of the crossover valve 305, which prevents the crossover valve 305 from shifting open.

When the control assembly 120 is operated to actuate the backhoe linkage 130 to decelerate the backhoe assembly 110, the pressure in the reclaim line 250 becomes higher than the pressure of the supply line 240 because of the load induced on the swing cylinders 260 by the kinetic energy of the backhoe assembly 110. The kinetic energy is transferred as fluid pressure in the reclaim line 250, and forces open the flow control valve 320. The open flow valve 320 allows the reclaim line to act upon the restrictor assembly 385. This produces a higher pressure being exerted through the restrictor assembly on the non-spring side of the crossover valve 305, but the pressure differential between the non-spring side and the spring side of the crossover valve 305 remains below the 40 psi needed to activate the crossover valve 305. If the flow and pressures of fluid in the return line 250 is great enough, the 100-psi check valve 330, preset to restrict flow to the opposite direction of the check valve 340, opens and creates a pressure differential in the reclaim line 250. This condition shifts the flow control valve 310 to open to the reclaim line 250 side and results in a higher pressure being exerted through the restrictor assembly 385 on the non-spring side of the crossover valve 305, than on the spring side. If the pressure differential between the two ports of the crossover valve 305 surpasses the 40-psi spring tension, the crossover valve 305 will open. The open crossover valve 305 permits a flow of pressurized fluid between the supply line 240 and the reclaim line 250 through the hydraulic lines 355*b* and 360*b*. In hydraulic lines 355*b* and 360*b* are crossover orifices 356 and 357, restricting the fluid flowing through hydraulic lines 355*b* and 360*b*. This results in improved 'metering' of the pressure equalization between the supply and reclaim lines 240 and 250.

While stopping the motion of the backhoe assembly 110, just before to just after returning the control lever of the controlling assembly 120 to neutral, some flow may pass through the control valve 220 and exit through the relief valve 230. The release of fluid through the relief valve 230 aids in maintaining the pressure differential exerted on the crossover valve 305, which prevents it from closing. When the exiting fluid pressure becomes lower then the spring tension of the relief valve 230, the relief valve 230 closes and the flow of fluid through the 100-psi check valve 330 stops. This causes the pressure exerted on the crossover valve 305 to equalize, resulting in the pressure differential to decrease below the 40-psi spring tension of the crossover valve 305, and the crossover valve 305 begins to shift closed.

When the crossover valve 305 begins to close, the restrictor assembly 385 controls the time required to complete the closing. It does this by slowing the flow of fluid between the non-spring side and spring side of the crossover valve 305, thus keeping the crossover valve 305 shifted for a short amount of time after the differentiating pressures have become negligible. At this time any pressure fluctuations within the supply line 240 and reclaim line 250, caused by the oscillating effect, are dampened by the fluid flow through the hydraulic lines 355*b* and 360*b*, and the crossover valve 305. This results in the reduction of the oscillatory motion when the swinging backhoe assembly 110 is brought to a stop.

In the illustrated embodiment, the restrictor assembly 385 of the swing cushion device 300 incorporates a 0.018" diameter delay orifice 380, a thermal actuator 365 and a delay volume 375. The restrictor assembly 385 regulates the shifting of the crossover valve 305 to the closed position. The thermal actuator 380 regulates the orifice size as oil temperature varies. The thermal actuator 380 adjusts the amount of pressure drop through the restrictor assembly 385 as temperature varies above or below a prescribed temperature, shown in this embodiment as open below 50° F. and closed above 60° F. In alternative embodiments, a solenoid and a temperature sensitive switch, a bimetallic element, or wax element could also be used as the thermal actuator 365. An in line filter 370 can be used to prevent contamination from affecting the operation of the restrictor assembly 385.

While specific embodiments of the present invention have been shown and described, it will be apparent to those skilled in the art that the disclosed invention may be modified in numerous ways and may assume many embodiments other than those specifically set out and described above. Accordingly, the scope of the invention is indicated in the appended claims, and all changes that come within the meaning and range of equivalents are intended to be embraced therein.

We claim:

1. A hydraulic system for regulating pressure equalization to suppress oscillation in a linkage of heavy equipment that is disposed to pivot about a pivotal axis comprising:

first and second pressure relief valves;

first and second hydraulic actuators;

first and second hydraulic lines respectively coupled to the first and second pressure relief valves and the first and second hydraulic actuator;

a crossover valve in communication with the first and second hydraulic lines between the first and second pressure relief valves and the first and second hydraulic actuators;

a timing system in communication with the crossover valve; and a motion detector in communication with a heavy equipment component wherein the motion detector senses linkage motion about the pivotal axis and operatively opens the crossover valve responsive to said motion, which remains open as directed by the timing system.

2. The system of claim 1 wherein the heavy equipment component is a component selected from the group consisting of a hydraulic line, a control assembly, or a heavy equipment linkage.

3. The system of claim 1 wherein the motion detector senses fluid motion and directs hydraulic flow to the crossover valve, which opens when a predetermined condition is met.

4. The system of claim 3 wherein the predetermined condition comprises a differential pressure.

5. The system of claim 1 wherein the motion detector contains a directional flow restricting system in communication with the crossover valve to allow fluid flow from one of the first or the second line to the crossover valve.

6. The system of claim 1 wherein the timing system determines how long the crossover valve allows flow between the first and second hydraulic lines.

7. The system of claim 1 further comprising at least one bypass orifice in communication with each the first and second hydraulic line.

8. The system of claim 1 wherein at least one crossover orifice is in communication with supply and return hydraulic lines and the crossover valve.

9. A hydraulic system for regulating pressure equalization to suppress oscillation in linkage of heavy equipment comprising:

a first and second hydraulic line;

a crossover valve in communication with the first and second hydraulic lines;

a timing system in communication with the crossover valve; and a motion detector in communication with a heavy equipment component wherein the motion detector senses linkage motion and operatively opens the crossover valve, which remains open as directed by the timing system wherein the timing system includes at least one delay orifice, at least one delay volume, and at least one thermal actuator restricting fluid flow to the crossover valve.

10. A hydraulic system for regulating pressure equalization to suppress oscillation in linkage of heavy equipment comprising:

a first and second hydraulic line;

a crossover valve in communication with the first and second hydraulic lines;

a timing system in communication with the crossover valve; and a motion detector in communication with a heavy equipment component wherein the motion detector senses linkage motion and operatively opens the crossover valve, which remains open as directed by the timing system wherein a relief valve is in communication with a control valve to aid in a timed opening and closing of the crossover valve.

11. A method of operating a hydraulic system to regulate pressure equalization including:

opening a crossover valve when a predetermined pressure differential is reached in a return hydraulic line;

metering fluid flow between a supply hydraulic line and return hydraulic line through the crossover valve;

restricting directional flow of fluid to the crossover valve; and delaying equalization of a pilot pressure to the crossover valve to extend open time of the crossover valve wherein a non-charged system pressure differential is minimized on opposing sides of the crossover valve by a plurality of bypass restrictors.

12. A method of operating a hydraulic system to regulate pressure equalization including:

opening a crossover valve when a predetermined pressure differential is reached in a return hydraulic line;

metering fluid flow between a supply hydraulic line and return hydraulic line through the crossover valve;

restricting directional flow of fluid to the crossover valve; and delaying equalization of a pilot pressure to the crossover valve to extend open time of the crossover valve wherein a charged system pressure differential is maintained on opposing sides of the crossover valve by a plurality of check valves.

13. A method of operating a hydraulic system to regulate pressure equalization including:

opening a crossover valve when a predetermined pressure differential is reached in a return hydraulic line;

metering fluid flow between a supply hydraulic line and return hydraulic line through the crossover valve;

restricting directional flow of fluid to the crossover valve; and delaying equalization of a pilot pressure to the crossover valve to extend open time of the crossover valve wherein the pressure differential is decreased in one of the supply and return hydraulic lines when a relief valve closes.

14. A hydraulic system for regulating pressure equalization comprising:

check valve means for increasing the fluid pressure in a return hydraulic line;

at least one pressure relief valve means to relieve fluid pressure in the return hydraulic line;

at least one hydraulic actuator in fluid communication with the return hydraulic line;

flow control valve means for allowing fluid pressure to be applied to a crossover valve;

crossover valve means for metering fluid pressure between first and second hydraulic lines; and restrictive means for delaying equalization of the pressure to the crossover valve to extend open time of the crossover valve, wherein the crossover valve means is in fluid communication with the return hydraulic line between the pressure relief valve means and the hydraulic actuator.

15. The system of claim 14 further comprising filtering means for preventing contamination from affecting a restrictor assembly.

16. The system of claim 14 further comprising a restrictor means for metering the fluid pressure in the charged hydraulic line.

17. A hydraulic system for regulating pressure equalization comprising:

check valve means for increasing the fluid pressure in a return hydraulic line;

flow control valve means for allowing fluid pressure to be applied to a crossover valve;

crossover valve means for metering fluid pressure between first and second hydraulic lines;

restrictive means for delaying equalization of the pressure to the crossover valve to extend open time of the crossover valve; and a relief valve means for allowing an excessive fluid to pass a control valve section, and aiding in a timed operation of the crossover valve.

18. A hydraulic system for regulating pressure equalization comprising:

check valve means for increasing the fluid pressure in a return hydraulic line;

flow control valve means for allowing fluid pressure to be applied to a crossover valve;

crossover valve means for metering fluid pressure between first and second hydraulic lines;

restrictive means for delaying equalization of the pressure to the crossover valve to extend open time of the crossover valve; and temperature means for regulation of a fluid restriction.

19. A hydraulic system for regulating pressure equalization comprising:

check valve means for increasing the fluid pressure in a return hydraulic line;

flow control valve means for allowing fluid pressure to be applied to a crossover valve;

crossover valve means for metering fluid pressure between first and second hydraulic lines;

restrictive means for delaying equalization of the pressure to the crossover valve to extend open time of the crossover valve; and at least one check valve and shuttle valve means for restricting directional flow of fluid to the crossover valve.

20. A hydraulic system for regulating pressure equalization to suppress oscillation in a linkage of heavy equipment comprising:

a first and second hydraulic line;

a crossover valve in communication with the first and second hydraulic lines;

a timing system in communication with the crossover valve;

a motion detector in communication with a heavy equipment component, wherein the motion detector senses linkage motion and operatively opens the crossover valve, which remains open as directed by the timing system; and wherein the timing system includes at least one thermal actuator that restricts fluid flow to the crossover valve.

21. A hydraulic system for regulating pressure equalization to suppress oscillation in a linkage of heavy equipment comprising:

a first and second hydraulic line;

a crossover valve in communication with the first and second hydraulic lines;

a timing system in communication with the crossover valve;

a motion detector in communication with a heavy equipment component, wherein the motion detector senses linkage motion and operatively opens the crossover valve, which remains open as directed by the timing system; and wherein a charged system pressure differential is maintained on opposing sides of the crossover valve by a plurality of check valves.

22. A hydraulic system for regulating pressure equalization to suppress oscillation in a linkage of heavy equipment comprising:

a first and second hydraulic line;

a crossover valve in communication with the first and second hydraulic lines;

a timing system in communication with the crossover valve;

a heavy equipment component including a backhoe assembly and a hydraulic actuator coupled to the backhoe assembly to move the backhoe assembly;

a motion detector in communication with a heavy equipment component, wherein the motion detector senses linkage motion and operatively opens the crossover valve, which remains open as directed by the timing system; and at least one check valve and shuttle valve for restricting directional flow of fluid to the crossover valve.

23. A hydraulic system for regulating pressure equalization to suppress oscillation in a linkage of heavy equipment comprising:

a first and second hydraulic line;

a crossover valve in communication with the first and second hydraulic lines;

a timing system in communication with the crossover valve;

a motion detector in communication with a heavy equipment component, wherein the motion detector senses linkage motion and operatively opens the crossover valve, which remains open as directed by the timing system; and wherein a pressure differential is decreased in one of the first and second hydraulic lines when a relief valve closes.

* * * * *